US009151163B2

(12) United States Patent
Siebel et al.

(10) Patent No.: US 9,151,163 B2
(45) Date of Patent: Oct. 6, 2015

(54) TURBOMACHINE ROTOR DISK

(71) Applicant: MTU Aero Engines GmbH, Munich (DE)

(72) Inventors: Matthias Siebel, Munich (DE); Heinz Rauschmair, Stadtbergen (DE); Andreas Hoelzel, Herrsching (DE)

(73) Assignee: MTU Aero Engines GmbH, Munich (DE)

( * ) Notice: Subject to any disclaimer, the term of this patent is extended or adjusted under 35 U.S.C. 154(b) by 422 days.

(21) Appl. No.: 13/688,975

(22) Filed: Nov. 29, 2012

(65) Prior Publication Data

US 2014/0147286 A1 May 29, 2014

(51) Int. Cl.

| | |
|---|---|
| ***F01D 5/14*** | (2006.01) |
| ***F01D 5/02*** | (2006.01) |
| *F01D 25/18* | (2006.01) |

(52) U.S. Cl.

CPC . *F01D 5/02* (2013.01); *F01D 25/18* (2013.01); *F05D 2250/14* (2013.01); *F05D 2260/602* (2013.01)

(58) Field of Classification Search

CPC ..... F05D 2260/602; F05D 2250/14; F05D 2240/20; F05D 2240/24; F05D 2240/242; F05D 2240/70; F01D 5/02; F01D 5/00; F01D 5/08; F01D 25/00; F01D 25/18

USPC ..... 416/244 A, 97 R; 415/115

See application file for complete search history.

(56) References Cited

U.S. PATENT DOCUMENTS

| | | | | |
|---|---|---|---|---|
| 4,465,429 | A * | 8/1984 | Martin et al. | 415/116 |
| 6,010,302 | A * | 1/2000 | Oeynhausen | 415/115 |
| 7,244,101 | B2 * | 7/2007 | Lee et al. | 416/97 R |
| 2007/0212226 | A1 * | 9/2007 | Guihard et al. | 416/244 A |

* cited by examiner

*Primary Examiner* — Edward Look
*Assistant Examiner* — Jason Mikus
(74) *Attorney, Agent, or Firm* — Davidson, Davidson & Kappel, LLC

(57) ABSTRACT

A rotor disk for a turbomachine, which is connectable to at least one rotor blade and/or a shaft of the turbomachine, having at least one borehole, which has an elliptical inlet opening having a first passage cross-sectional area and an elliptical outlet opening having a second passage cross-sectional area, so that the second passage cross-sectional area is smaller than the first passage cross-sectional area.

19 Claims, 1 Drawing Sheet

TURBOMACHINE ROTOR DISK

The present invention relates to a rotor disk for a turbomachine and a turbomachine having such a rotor disk.

BACKGROUND

Rotor disks for turbomachines, which are shrunk onto a shaft of the turbomachine, for example, and are coupled to rotor blades of the turbomachine, are known from the related art. Passage boreholes for fluids such as oil are formed in the rotor disks. Such boreholes are cavities having small passage cross-sectional areas, which offer advantages for a "secondary air system."

Rotor disks, in which the passage boreholes are formed as cylindrical boreholes and/or as elongated holes, are already known.

SUMMARY OF THE INVENTION

In the case of clamp joint rotors, areas of high stress peaks may result from high prestressing forces and centrifugal forces on the borehole flanks. The stress peaks may lead to damage to the cylindrical borehole and/or the elongated hole, which may thus shorten the lifetime of the rotor disk.

It is an object of the present invention to provide an improved turbomachine rotor disk.

The present invention provides a rotor disk for a turbomachine. The rotor disk is connectable to one or more rotor blades and/or a shaft of the turbomachine. The rotor disk may be connected to the shaft in particular in a frictionally locked manner, for example, by shrinking it onto the shaft. Other types of connections for connecting the rotor disk to the shaft of the turbomachine are naturally also possible. The connection of the rotor disk to the rotor blades may be detachable, for example, by insertion, or may be permanent, in particular by integral joints.

The rotor disk has one or more boreholes, which have an elliptical inlet opening including a first passage cross-sectional area and an elliptical outlet opening including a second passage cross-sectional area. The second passage cross-sectional area is smaller than the first passage cross-sectional area.

Stress peaks on the flanks of the boreholes may be reduced by providing elliptical inlet openings and outlet openings. Additionally or alternatively, the stress peaks on the flanks of the boreholes may be reduced if the borehole is designed in such a way that the second passage cross-sectional area of the outlet opening is smaller than the first passage cross-sectional area of the inlet opening. The risk of damage to the rotor disk may be reduced by reducing the stress peaks, so that the lifetime of the rotor disk may be increased.

In the sense of the present invention, an elliptical opening is understood in particular to be an opening having a finite or limited number of planes of symmetry, i.e., an opening which is not circular in shape. In particular, the elliptical opening may have at least one, in particular exactly two, three or four planes of symmetry. If the elliptical opening has exactly two planes of symmetry, then the opening has an elliptical shape in the narrower sense.

The borehole may be an oil throw-off borehole, which may preferably be situated in a disk arm of the rotor disk. The oil throw-off borehole may conduct oil in the direction of a blade receptacle of the rotor blade, for example. A disk arm is understood in particular to be a section protruding from the rotor disk, preferably in the axial direction.

In one embodiment, a midpoint of the inlet opening may be arranged at an offset in at least two directions, in particular three directions, in relation to a midpoint of the outlet opening. Due to the offset of the midpoints, the two openings may advantageously also be offset in relation to one another.

In one embodiment, the borehole may be designed in such a way that the passage cross-sectional area between the inlet opening and the outlet opening is reduced monotonically at least in part. The borehole may have sections in which the passage cross-sectional area remains constant and therefore does not change. In a refinement of the present invention, the borehole may have sections in which the passage cross-sectional area is reduced in a linear fashion. In particular the passage cross-sectional area between the inlet opening and the outlet opening may be reduced in a linear fashion over the entire length of the borehole. Stress peaks in the flanks of the boreholes may be further reduced through such a borehole having a passage cross-sectional area, which is reduced monotonically at least in part.

The aforementioned change in the cross section, in particular the reduction in the passage cross-sectional area between the inlet opening and the outlet opening, may have advantages in terms of the structural mechanics and fabrication technology in particular. The edges of boreholes may be machined very well on the inside as well as on the outside in particular. An inlet opening edge and an outlet opening edge in particular may be at least partially rounded and/or chamfered or designed or provided with a radius and/or a chamfer.

The reduction in the passage cross-sectional area between the inlet opening and the outlet opening may be greater in a plane of symmetry of the borehole or may be greater than in another plane of symmetry, such that the planes of symmetry may be perpendicular to one another. In the case of a borehole having two planes of symmetry, the reduction in the passage cross-sectional area may be greater in the plane of symmetry containing a main axis of the opening than in another plane of symmetry containing a secondary axis of the opening. The main axis and the secondary axis are perpendicular to one another and they both run through the midpoint of the opening, so that the main axis is designed to be longer than the secondary axis.

In one embodiment of the rotor disk in particular, an extent of the borehole, in particular a secondary axial length in a first plane of symmetry of the inlet opening, may amount to at least 4.13 mm and/or at most 4.31 mm. Additionally or alternatively, an extent of the borehole, in particular a secondary axial length in a first plane of symmetry of the outlet opening, may amount to at most 4.13 mm and/or at least 3.95 mm. Additionally or alternatively, an extent of the borehole, in particular a main axial length in a second plane of symmetry of the inlet opening, may amount to at least 6.96 mm and/or at most 7.28 mm. Additionally or alternatively, an extent of the borehole, in particular a secondary axial length in a second plane of symmetry of the outlet opening, may amount to at most 6.96 mm and/or at least 6.64 mm. Additionally or alternatively, a normal between the inlet opening and the outlet opening may be at least 6 mm and/or at most 7 mm, in particular 6.97 mm.

The rotor disk may be inserted into a turbine engine, for example a gas turbine.

BRIEF DESCRIPTION OF THE DRAWINGS

Additional features and advantages are derived from the subclaims and the exemplary embodiment. In this regard, partially schematically:

DETAILED DESCRIPTION

Figure 1:
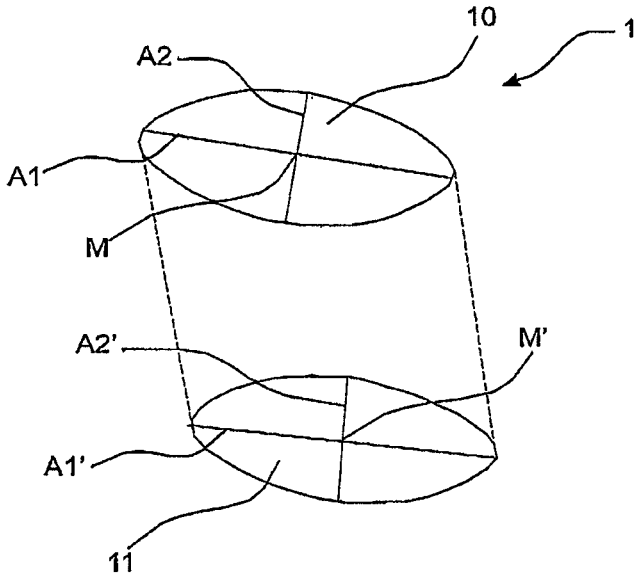
FIG. 1 shows a perspective diagram of the borehole of FIG. 2.

A borehole 1 shown in FIG. 1 has an inlet opening 10 and an outlet opening 11. Both inlet opening 10 and outlet opening 11 are designed to be elliptical, each having exactly two planes of symmetry oriented perpendicularly to one another.

A first plane of symmetry contains a main axis A1 of the inlet opening, and a second plane of symmetry contains a secondary axis A2 of the inlet opening. Main axis A1 and secondary axis A2 intersect at midpoint M of inlet opening 10, main axis A1 being designed to be longer than secondary axis A2.

Outlet opening 11 also has a first plane of symmetry containing a main axis A1' of outlet opening 11. Furthermore, outlet opening 11 has a second plane of symmetry, which contains a secondary axis A2' of outlet opening 11. Main axis A1' and secondary axis A2' of outlet opening 11 intersect at a midpoint M' of outlet opening 11 and run perpendicularly to one another. Furthermore, main axis A1' of outlet opening 11 is designed to be longer than secondary axis A2' of the outlet opening.

Midpoint M' of outlet opening 11 is arranged with an offset in three directions in relation to midpoint M of inlet opening 10. Accordingly, outlet opening 11 is arranged with an offset in three directions with respect to inlet opening 10.

Outlet opening 11 has a smaller passage cross-sectional area with respect to inlet opening 10. There is a constant linear reduction in the passage cross-sectional area between inlet opening 10 and outlet opening 11. Accordingly, the borehole has a conical shape in the area between inlet opening 10 and outlet opening 11.

The passage cross-sectional area is reduced in the plane of symmetry containing the main axis as well as in the plane of symmetry containing the secondary axis. The reduction in the borehole between inlet opening 10 and outlet opening 11 in the direction of the plane of symmetry containing the main axis is greater than in the direction of the plane of symmetry containing the secondary axis.

Figure 2:
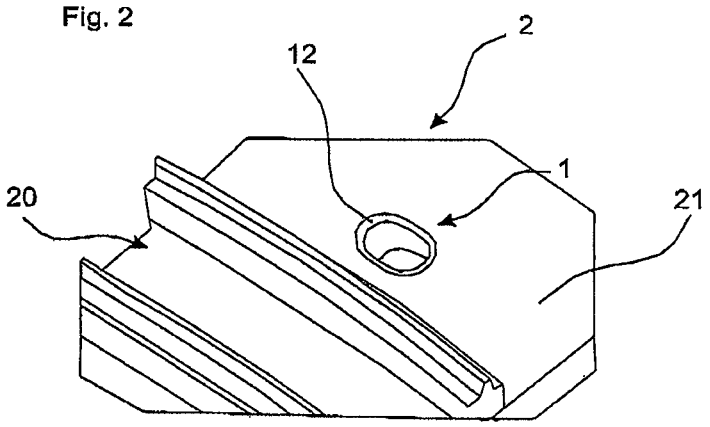
FIG. 2 shows a part of the rotor disk according to one embodiment of the present invention.

FIG. 2 shows a detail of a rotor disk 2 of a gas turbine having a borehole 1, so that borehole 1 is an oil throw-off borehole for carrying oil. Borehole 1 is provided in a disk arm 21 of rotor disk 2. Rotor disk 2 has a blade receptacle 20 for accommodating the blades in proximity to disk arm 21.

Borehole 1 is situated in rotor disk 2 in such a way that inlet opening 10 is provided on the side facing away from blade receptacle 20, and outlet opening 11 is provided in the side of rotor disk 2 containing blade receptacle 20. An outlet opening edge 12 of outlet opening 11 is rounded here.

Commonly-assigned U.S. Patent Application No. 2010/0104418 is hereby incorporated by reference herein.

LIST OF REFERENCE NUMERALS

1 borehole
2 rotor disk
10 inlet opening
11 outlet opening
12 outlet opening edge
20 blade receptacle
21 disk arm
M midpoint of the inlet opening
M' midpoint of the outlet opening
A1 main axis of the inlet opening
A2 secondary axis of the inlet opening
A1' main axis of the outlet opening
A2' secondary axis of the outlet opening

What is claimed is:

1. A rotor disk for a turbomachine, the rotor disk connectable to at least one rotor blade and/or a shaft of the turbomachine, the rotor disk comprising:

at least one oil throw-off borehole having an elliptical inlet opening including a first passage cross-sectional area and an elliptical outlet opening including a second passage cross-sectional area, the second passage cross-sectional area being smaller than the first passage cross-sectional area, wherein the passage cross-sectional area between the inlet opening and the outlet opening is reduced at least partially monotonically.

2. The rotor disk as recited in claim 1 wherein the passage cross-sectional area between the inlet and outlet opening is reduced at least partially linearly.

3. The rotor disk as recited in claim 1 wherein a midpoint of the inlet opening is offset in relation to a midpoint of the outlet opening in at least two directions.

4. The rotor disk as recited in claim 1 wherein the reduction in the passage cross-sectional area in a plane of symmetry of the borehole is greater than that in another plane of symmetry of the borehole.

5. The rotor disk as recited in claim 1 wherein an extent of the borehole in a first plane of symmetry of the inlet opening amounts to at least 4.13 mm.

6. The rotor disk as recited in claim 1 wherein an extent of the borehole in a first plane of symmetry of the inlet opening amounts to at most 4.31 mm.

7. The rotor disk as recited in claim 1 wherein an extent of the borehole in a first plane of symmetry of the outlet opening amounts to at least 3.95 mm.

8. The rotor disk as recited in claim 1 wherein an extent of the borehole in a first plane of symmetry of the outlet opening amounts to at most 4.13 mm.

9. The rotor disk as recited in claim 1 wherein an extent of the borehole in a first plane of symmetry of the inlet opening amounts to at least 4.13 and at most 4.31 mm, and an extent of the borehole in a first plane of symmetry of the outlet opening amounts to at least 3.95 mm and at most 4.13 mm.

10. The rotor disk as recited in claim 1 wherein an extent of the borehole in a second plane of symmetry of the inlet opening amounts to at least 6.96 mm.

11. The rotor disk as recited in claim 1 wherein an extent of the borehole in a second plane of symmetry of the inlet opening amounts to at most 7.28 mm.

12. The rotor disk as recited in claim 1 wherein an extent of the borehole in a second plane of symmetry of the outlet opening amounts to at least 6.64 mm.

13. The rotor disk as recited in claim 1 wherein an extent of the borehole in a second plane of symmetry of the outlet opening amounts to at most 6.96 mm.

14. The rotor disk as recited in claim 1 wherein an extent of the borehole in a second plane of symmetry of the inlet opening amounts to at least 6.96 and at most 7.28 mm, and an extent of the borehole in a second plane of symmetry of the outlet opening amounts to at least 6.64 mm and a most 6.96 mm.

15. The rotor disk as recited in claim 1 wherein a normal between the inlet opening and the outlet opening is at least 6 mm and/or at most 7 mm.

16. The rotor disk as recited in claim 15 wherein the normal is 6.97 mm long.

17. A rotor disk for a turbomachine, the rotor disk connectable to at least one rotor blade and/or a shaft of the turbomachine, the rotor disk comprising:

at least one oil throw-off borehole having an elliptical inlet opening including a first passage cross-sectional area and an elliptical outlet opening including a second passage cross-sectional area, the second passage cross-sectional area being smaller than the first passage cross-sectional area, wherein an inlet opening edge and/or an outlet opening edge is at least partially rounded or chamfered.

18. A turbomachine comprising the rotor disk as recited in claim 1.

19. A gas turbine comprising the rotor disk as recited in claim 1.

* * * * *